US011952163B2

(12) United States Patent
Palmer et al.

(10) Patent No.: US 11,952,163 B2
(45) Date of Patent: Apr. 9, 2024

(54) CONTAINER WITH REINFORCED NECK

(71) Applicant: Altium Packaging LP, Atlanta, GA (US)

(72) Inventors: Joey Arlin Palmer, Marietta, GA (US); Robert Anthony Spagnoli, Cement City, MI (US); Joseph Anthony Smarrelli, Jr., New Castle, PA (US)

(73) Assignee: Altium Packaging LP, Atlanta, GA (US)

( * ) Notice: Subject to any disclaimer, the term of this patent is extended or adjusted under 35 U.S.C. 154(b) by 0 days.

(21) Appl. No.: 17/833,237

(22) Filed: Jun. 6, 2022

(65) Prior Publication Data

US 2022/0388709 A1 Dec. 8, 2022

Related U.S. Application Data

(60) Provisional application No. 63/197,940, filed on Jun. 7, 2021.

(51) Int. Cl.
*B65D 1/46* (2006.01)
*B65D 1/02* (2006.01)

(52) U.S. Cl.
CPC ..... *B65D 1/46* (2013.01); *B65D 1/0246* (2013.01); *B65D 1/0276* (2013.01); *B65D 2501/0036* (2013.01)

(58) Field of Classification Search
CPC ..... B65D 1/0276; B65D 1/046; B65D 2501/0027; B65D 2501/0036
See application file for complete search history.

(56) References Cited

U.S. PATENT DOCUMENTS

| | | | |
|---|---|---|---|
| D67,874 | S | 7/1925 | Bromley |
| D95,419 | S | 4/1935 | Grey |
| D111,794 | S | 10/1938 | Oswell |
| D112,381 | S | 11/1938 | Sauer, Jr. |
| D164,964 | S | 10/1951 | Serra |
| 2,953,271 | A | 9/1960 | John et al. |

(Continued)

FOREIGN PATENT DOCUMENTS

| | | |
|---|---|---|
| CN | 202054192 | 11/2011 |
| FR | 3022896 | 1/2016 |

OTHER PUBLICATIONS

Notice of Allowance, dated Jul. 14, 2023, from corresponding U.S. Appl. No. 29/787,481.

*Primary Examiner* — Andrew T Kirsch
(74) *Attorney, Agent, or Firm* — Brient IP Law, LLC

(57) ABSTRACT

A container includes an outlet defining an opening that is in fluid communication with an interior portion of the container, the outlet having a central axis. The container also a neck portion having an upper structural ring lying in a first plane that is substantially perpendicular to the central axis, and a lower structural ring lying in a second plane that is substantially perpendicular to the central axis, wherein the first plane and the second plane being separated by a vertical distance. The neck portion may have a gusset extending between the upper structural ring and the lower structural ring, and the gusset may have a plane of symmetry, wherein the central axis lies in the plane of symmetry. The container further includes a shoulder beneath the neck portion, a waist section beneath the shoulder, and a base beneath the waist section.

18 Claims, 14 Drawing Sheets

(56) References Cited

U.S. PATENT DOCUMENTS

D193,741 S 10/1962 Westhoven et al.
D195,697 S 7/1963 Price et al.
D197,190 S 12/1963 Natale et al.
D200,672 S 3/1965 Swayze
D201,051 S 5/1965 Shepler
D201,103 S 5/1965 Caisse
D203,560 S 1/1966 Erickson
D204,701 S 5/1966 Shepler
D208,824 S 10/1967 Platte
D213,821 S 4/1969 Platte
D215,410 S 9/1969 Hills
D221,515 S 8/1971 Betka
D222,340 S 10/1971 Weckman
D229,296 S 11/1973 Cutler
D238,654 S 2/1976 Platte
D250,995 S 2/1979 Beaver
4,293,080 A * 10/1981 Letica ..... B65D 1/22 220/675
D264,435 S 5/1982 Pettengill
D264,436 S 5/1982 Pettengill
D264,813 S 6/1982 Potter
4,372,455 A 2/1983 Cochran
D273,461 S 4/1984 Sevenoaks
D286,000 S 10/1986 Bussell
D286,379 S 10/1986 Lyons
D292,378 S 10/1987 Brandt et al.
D309,421 S 7/1990 Aldrich, III
4,964,522 A 10/1990 Umetsu et al.
5,067,622 A * 11/1991 Garver ..... B29C 49/64 215/381
D322,936 S 1/1992 Maginnis, Jr.
D348,612 S 7/1994 Ring
D356,264 S 3/1995 Praturlon et al.
D356,265 S 3/1995 Moloney et al.
D368,035 S 3/1996 Ahern, Jr.
D379,929 S 6/1997 Dallaire
D380,647 S 7/1997 Durand
D391,854 S 3/1998 Ankney et al.
5,735,421 A 4/1998 Deemer et al.
5,833,115 A 11/1998 Eiten
D408,292 S 4/1999 Gundlach et al.
D421,393 S 3/2000 Pavely et al.
6,068,161 A 5/2000 Soehnlen et al.
D427,076 S 6/2000 Ankney et al.
D428,814 S 8/2000 Silvers et al.
D428,817 S 8/2000 Olson et al.
6,220,475 B1 4/2001 Nayar et al.
6,237,792 B1 5/2001 Skolnicki et al.
D467,503 S 12/2002 Silvers et al.
D470,417 S 2/2003 Anderson
6,527,133 B1 3/2003 McCollum et al.
6,588,612 B1 7/2003 Dorn et al.
6,612,451 B2 9/2003 Tobias et al.
D485,497 S 1/2004 Steele, IV et al.
6,672,468 B1 1/2004 Mount et al.
D488,721 S 4/2004 Peronek
D495,602 S 9/2004 Daly et al.
6,889,858 B2 5/2005 McCollum et al.
6,926,163 B2 8/2005 Darr et al.
6,932,228 B1 * 8/2005 Darr ..... B65D 1/0276 206/509
6,971,530 B2 12/2005 Darr
D514,949 S 2/2006 Dalton et al.
6,998,091 B2 2/2006 Izuka et al.
D518,725 S 4/2006 Eble
7,051,889 B2 5/2006 Boukobza
7,059,486 B2 6/2006 Van Der Heijden et al.
D528,003 S 9/2006 Livingston et al.
D529,337 S 10/2006 Carreno et al.
D538,166 S 3/2007 Bertin et al.
D539,156 S 3/2007 Fraser et al.
D539,661 S 4/2007 Eble
D559,692 S 1/2008 Floyd et al.
D593,863 S 6/2009 Fahy et al.
D603,707 S 11/2009 Lourenco et al.
D606,870 S 12/2009 Kaminski et al.
D611,826 S 3/2010 Kuroki et al.
7,686,168 B1 3/2010 Smiley et al.
7,699,171 B2 4/2010 Rivera et al.
7,789,255 B2 9/2010 Zoppas
D624,824 S 10/2010 Perez et al.
D641,629 S 7/2011 Miceli et al.
8,047,392 B2 11/2011 Eiten et al.
D652,729 S 1/2012 Young et al.
D662,421 S 6/2012 Dorn
8,276,775 B2 10/2012 Boukobza
8,281,953 B2 10/2012 Yourist
D678,072 S 3/2013 Lobbestael et al.
D685,641 S 7/2013 Tomkins et al.
D686,080 S 7/2013 Tomkins et al.
D697,408 S 1/2014 Eble
8,668,101 B2 3/2014 Lobbestael et al.
D706,638 S 6/2014 Fleischhacker et al.
8,893,908 B2 11/2014 Treece et al.
8,979,524 B2 3/2015 Lobbestael et al.
D733,566 S 7/2015 Lobbestael et al.
D739,248 S 9/2015 Janeczek
D742,747 S 11/2015 Lobbestael et al.
9,352,873 B2 5/2016 Dorn
9,446,551 B2 9/2016 Lobbestael et al.
9,617,029 B2 4/2017 Lane et al.
9,650,170 B2 5/2017 Oostwouder
D800,567 S 10/2017 Palmer et al.
D805,393 S 12/2017 Eble
D815,947 S 4/2018 Hurley et al.
9,981,768 B1 5/2018 Palmer et al.
D823,690 S 7/2018 Palmer et al.
D823,691 S 7/2018 Palmer et al.
10,259,609 B2 4/2019 Kuhar et al.
D847,653 S 5/2019 Eble
10,384,824 B2 8/2019 Palmer et al.
D859,994 S 9/2019 Eble
D874,284 S 2/2020 Palmer et al.
D874,940 S 2/2020 Janeczek et al.
10,549,879 B2 2/2020 Palmer et al.
10,730,655 B2 8/2020 Grabher
D903,420 S 12/2020 Kander
D906,112 S 12/2020 Mcfarlane et al.
D906,113 S 12/2020 Mcfarlane et al.
D908,433 S 1/2021 Sapire et al.
D916,593 S 4/2021 Mcfarlane et al.
D920,799 S 6/2021 Manderfield et al.
11,027,884 B2 6/2021 Manderfield et al.
D932,311 S 10/2021 Manderfield et al.
2007/0023384 A1 2/2007 Janeczek
2010/0089863 A1 4/2010 Matsuoka
2011/0284541 A1 11/2011 Webster et al.
2013/0001234 A1 1/2013 Glover
2015/0014274 A1 1/2015 Glover
2016/0272356 A1 9/2016 Simpson et al.
2021/0214116 A1 7/2021 Palmer et al.
2021/0261298 A1 8/2021 Manderfield et al.

* cited by examiner

CONTAINER WITH REINFORCED NECK

CROSS-REFERENCE TO RELATED APPLICATIONS

This application claims priority to U.S. Provisional Patent Application Ser. No. 63/197,940, filed Jun. 14, 2021, entitled "CONTAINER," the disclosure of which is hereby incorporated by reference in its entirety.

BACKGROUND

Conventional wide mouth containers are often used to store solid items that may be too large to pour. These containers may also be used to store viscous or semi-solid materials that must be scooped from a container rather than poured. As a result, these containers may have mouths large enough for a person's hand to enter the container.

Further, these containers are often formed of plastic. Plastic manufacturing techniques allow for virtually any shape, size, and configuration of container that is easy to use and often targeted to a specific material to be stored or use of that container and material within. However, when a wide mouth container contains dense objects or materials, thick walls are conventionally used to provide sufficient structural strength. Thick walls increase manufacturing costs, however, and increase the container weight, thereby increasing shipping costs. Conversely, some traditional containers rely on thinner walls to reduce material costs. However, these thin wall containers may be unable to withstand certain external forces and therefore may be unsuitable for certain applications. As a result, thin wall containers may be unable to be stacked, reducing shipping options and increasing costs.

Consequently, there is a need for improved containers that allow for storage and easy access to goods, while reducing costs by providing versatile shipping options and reducing manufacturing costs.

SUMMARY

A container according to various embodiments of the present disclosure includes an outlet defining an opening that is in fluid communication with an interior portion of the container, the outlet having a central axis. The container also a neck portion having an upper structural ring lying in a first plane that is substantially perpendicular to (e.g., perpendicular to) the central axis, and a lower structural ring lying in a second plane that is substantially perpendicular to (e.g., perpendicular to) the central axis, wherein the first plane and the second plane are separated by a vertical distance. The neck portion may have a gusset extending between the upper structural ring and the lower structural ring, and the gusset may have a plane of symmetry, wherein the central axis lies in the plane of symmetry. The container further includes a shoulder beneath the neck portion, a waist section beneath the shoulder, and a base beneath the waist section.

In additional embodiments, a mold for forming a container includes a top portion having a top horizontal recess configured to form a top rib of a container; a lower horizontal recess configured to form a lower rib of the container; a middle protrusion disposed between the top horizontal recess and the lower horizontal recess; and a plurality of gusset recesses configured to form a plurality of gussets extending between the top rib and the lower rib. The mold also includes a middle portion having a cylindrical section configured to form a panel section of the container; and at least one horizontal rib protrusion having a radius less than a radius of the cylindrical section. The mold further includes a bottom section configured to form a base of the container.

Further, according to various embodiments of the present disclosure, a method of manufacturing a wide mouth container includes heating a tube of a material until the material is above a glass transition temperature of the material and surrounding the tube with a mold. The mold includes a top portion having a top horizontal recess configured to form an upper structural ring; a lower horizontal recess configured to form a lower structural ring; a middle protrusion disposed between the top horizontal recess and the lower horizontal recess; and a plurality of gusset recesses configured to form a plurality of gussets extending between the upper structural ring and the lower structural ring. The mold also includes a middle portion having a cylindrical section configured to form a panel section of the wide mouth container; and at least one horizontal rib protrusion having a radius less than a radius of the cylindrical section. Further, the mold includes a bottom section configured to form a base of the wide mouth container. The method also includes pressing the tube against the mold using a pressurized gas; and releasing the wide mouth container from the mold.

BRIEF DESCRIPTION OF THE DRAWINGS

Various embodiments are described below. In the course of this description, reference will be made to the accompanying drawings, which are not necessarily drawn to scale, and wherein.

DETAILED DESCRIPTION

Various embodiments will now be described more fully hereinafter with reference to the accompanying drawings. It should be understood that the concepts disclosed herein may be embodied in many different forms and should not be construed as limited to the embodiments set forth herein. Rather, these embodiments are provided so that this disclosure will be thorough and complete, and will fully convey the scope of the disclosure to those skilled in the art. Like numbers refer to like elements throughout.

Wide mouth containers may be used to store and ship items that a person may desire to dispense individually. For instance, food products like snacks (e.g., pretzels, candy, cookies, etc.) may be shipped in wide mouth containers that allow a person to take one unit at a time (e.g., one pretzel at a time). Wide mouth containers may also store varieties of an item, such as varieties of candy, and the wide opening may allow a person to select a desired flavor. Further, wide mouth containers may be useful in bulk shipment and purchases of goods by having a large volume that is easily accessed by a consumer. For instance, a wide mouth container may include a dense substance (e.g., ice cream, peanut butter, shortening, etc.) that is too viscous to be poured from a narrow opening, and which a consumer may scoop out with a utensil, thus requiring a wide opening for the consumer's hand and utensil. In certain cases, manufacturers may store heavy items in wide mouth containers, such as screws or other hardware items, as well.

However, in order to benefit from the economies of scale of shipping bulk goods, as well as maximizing storage density in warehouses and stores, merchants and shippers may desire to stack wide mouth containers. In cases where the wide mouth containers hold dense, heavy goods, the stacking height of the wide mouth containers may be limited by the container's material strength. However, adding more material to the container to increase strength may increase costs as well by increasing raw material consumption and shipping weight. Thus, various embodiments of the present disclosure provide structural reinforcement designs for wide mouth containers that improve stacking height and container durability without significant addition of raw material or weight.

Figure 1:
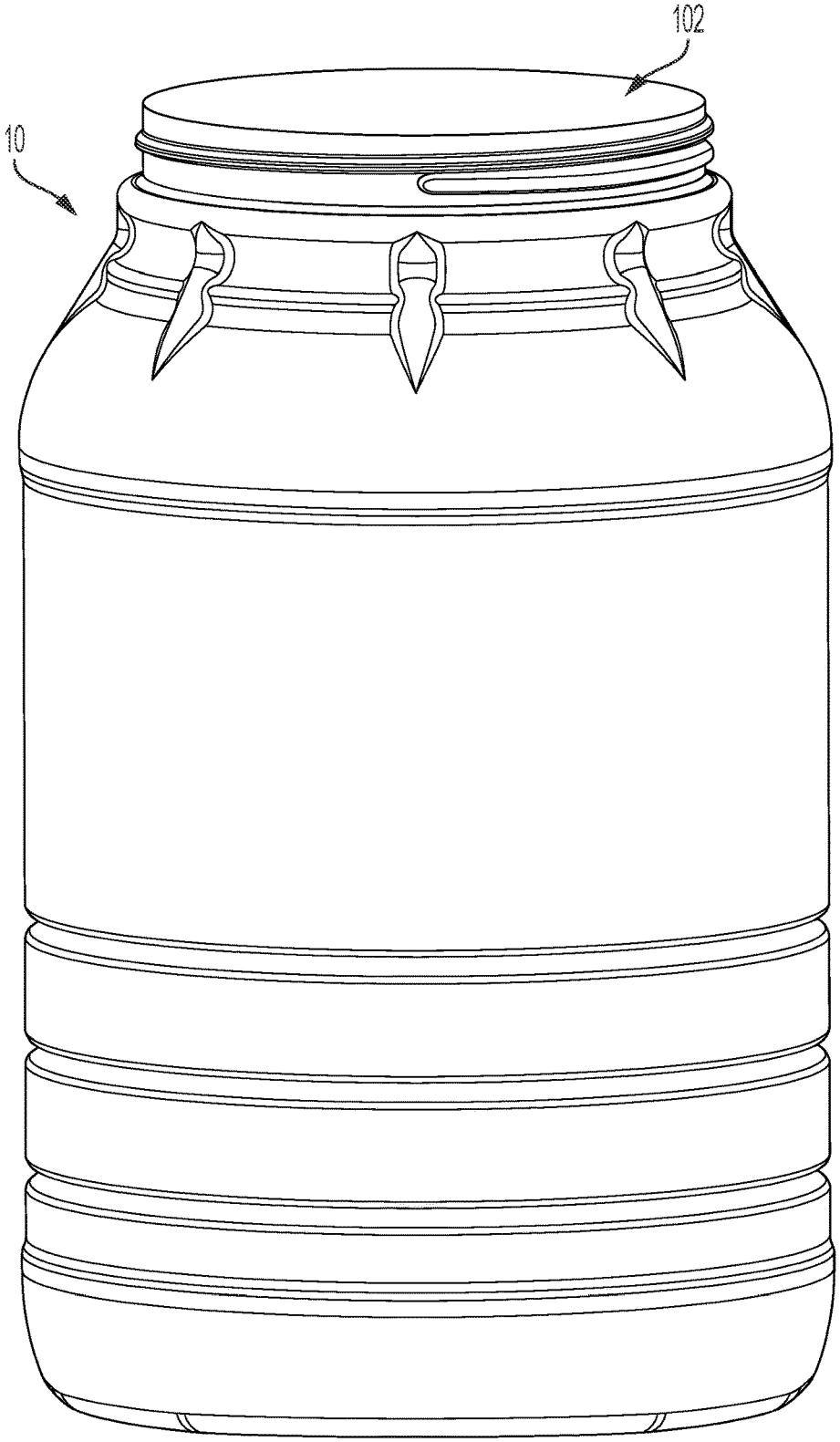
FIG. 1 is a top front perspective view of a container according to various embodiments described herein.
Figure 2:
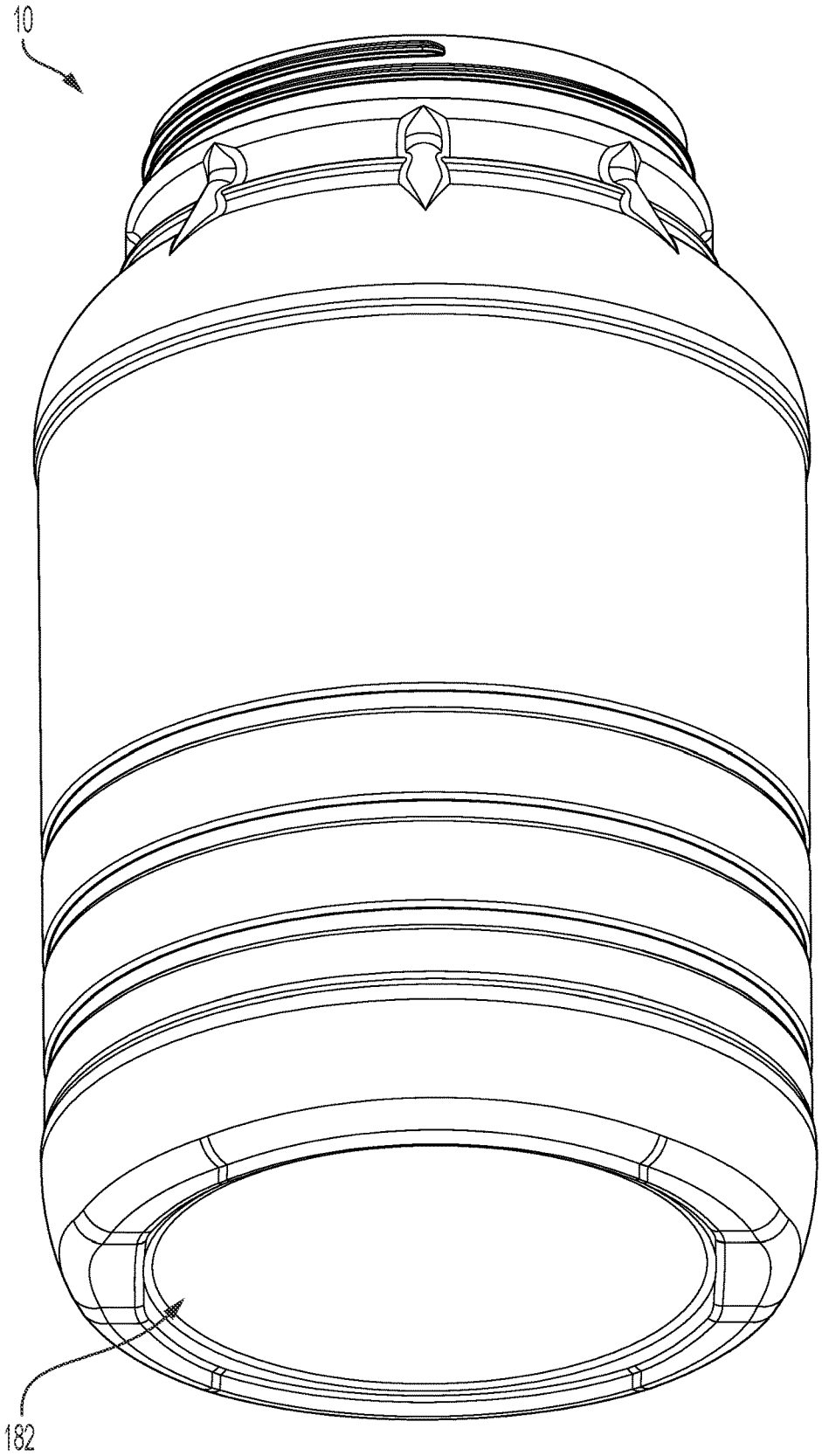
FIG. 2 is a bottom front perspective view of the container of FIG. 1.
Figure 3:
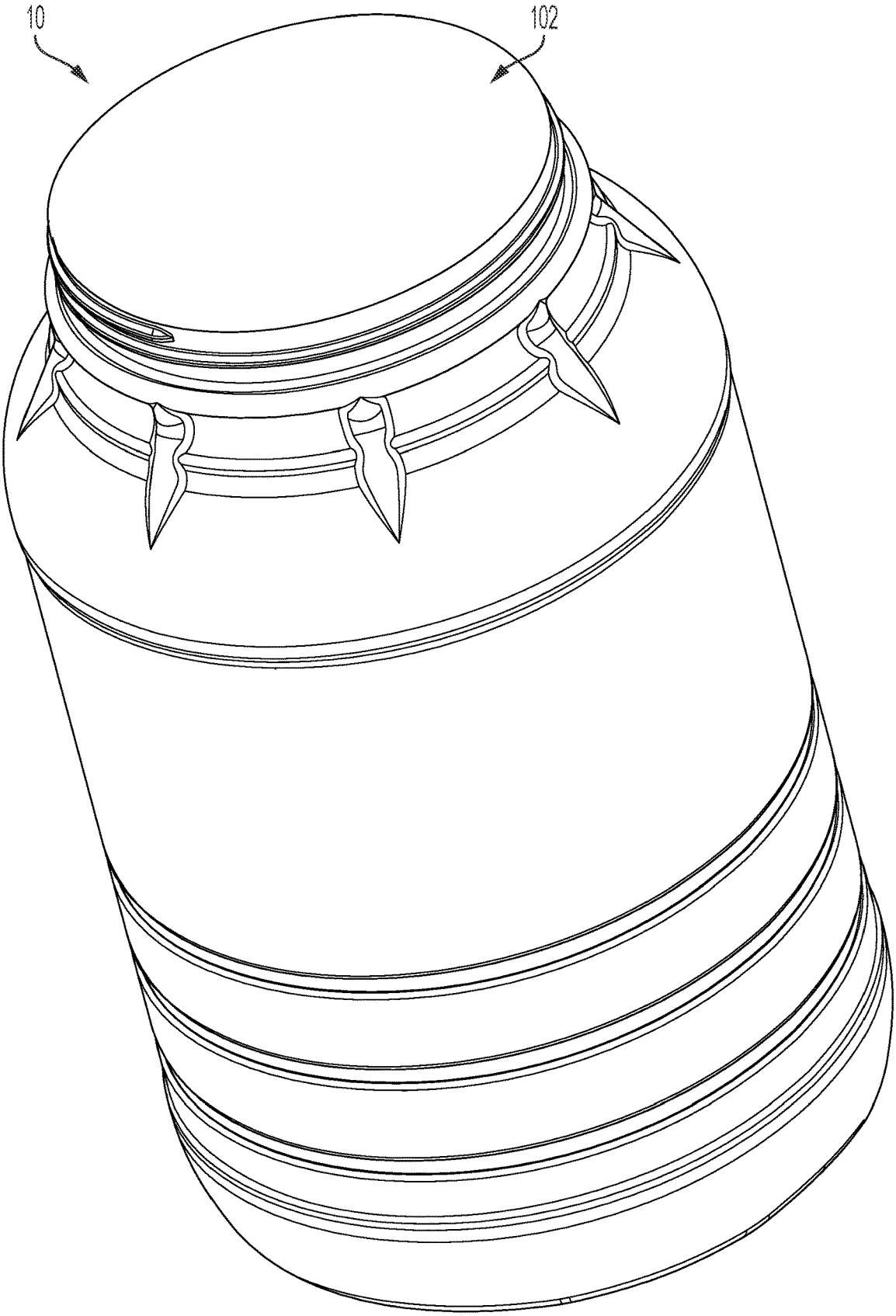
FIG. 3 is a second top front perspective view of the container of FIG. 1.

FIGS. 1-3 illustrate various views of a particular embodiment of a container 10. The container 10 defines an interior storage portion. The interior storage portion may be used to contain goods, and may, for instance, have a volume of approximately one gallon. It should be understood that while the container shown may be depicted in a particular size, in alternative embodiments, the container may be in any other suitable size (e.g., one liter, two liters, three liters, etc.). The container 10 may be made of any suitable material, such as plastic (e.g., high density polyethylene, polyethylene terephthalate, etc.) or glass.

The container 10 also includes an outlet having an opening 102 that is in fluid communication with an interior portion of the container. The opening may be substantially circular about a central axis, for instance. Further, the opening may be sized to allow suitable contents (e.g., one or more food items or other items) to be transferred to and from the container's interior. The opening may also be sized to allow a human hand to fit into the container, or, in some embodiments, a hand holding a utensil (e.g., spoon, knife, etc.). In certain embodiments, the outlet opening may be so dimensioned so that a consumer may grip a lid secured to the opening with a single hand. Accordingly, the opening may be, for example, less than about six inches in diameter in some embodiments (e.g., between about four inches and about 6 inches in diameter).

Figure 4:
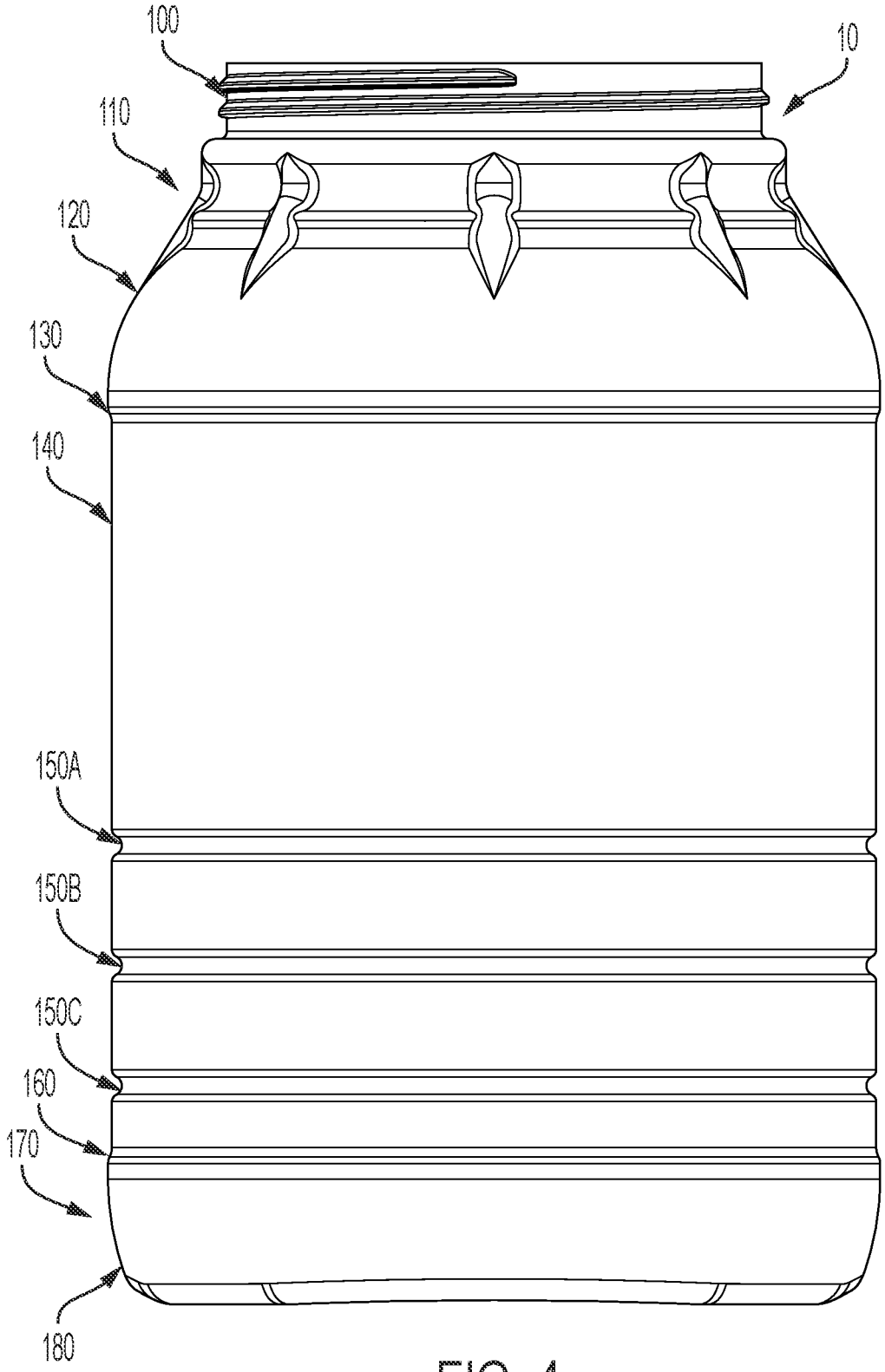
FIG. 4 is a front view of the container of FIG. 1.

FIG. 4 illustrates various features of the container 10 which aid in providing structural integrity to the container 10, thereby improving container durability, such as during shipping and handling. For instance, the container 10 may include a threaded outlet 100 adapted to rotationally and removably attach to a suitable threaded lid (not shown) so that the lid selectively blocks access to items within the container and, in various embodiments, prevents items from spilling out of the container. The threaded outlet may comprise a small number of thread turns (e.g., 1 complete turn, 1.5 turns, 2 turns, etc.) thereby enabling easy opening by a consumer. Further, a small number of turns may help a consumer to remove the lid with only one hand, making opening and closing easier.

The container 10 may also include a substantially circular neck portion 110 below the outlet 100. The neck portion 110 may have a diameter greater than a diameter of the outlet. In certain embodiments, a lid secured on the thread of the outlet may rest on a rim forming a transition from a smaller outlet diameter to the greater neck portion diameter. Further details of the neck portion will be discussed with reference to FIGS. 4 and 8.

As shown in FIG. 4, the container's shoulder portion 120 is disposed beneath the container's neck portion 110. The shoulder 120 may provide a transition from the smaller diameter outlet 100 and neck portion 110 to a larger diameter region of the container 10. In various embodiments, each horizontal cross section of this shoulder portion is substantially circular, and the horizontal cross-sectional area of the shoulder portion at least generally increases from the top to the bottom of the shoulder portion. In various embodiments, the radius of the largest circular interior cross-section of the shoulder portion may, for example, be about 10% to about 30% larger than the circular interior cross section of the outlet 100.

The shoulder 120 may include a bumper 130 at the bottom of the shoulder 120. The top bumper 130 may be substantially circular and concentric with the outlet. Further, the top bumper 130 may have an outside wall with a diameter at least as large as a largest diameter of the shoulder 120. The top bumper 130 may provide an upper boundary to a waist section 140 disposed beneath the shoulder. Thus, a maximum radius of the bumper 130 may be greater than a maximum radius of the waist section 140. For example, in some embodiments, the waist section 140 may have a diameter slightly smaller than the top bumper 130 (e.g., the waist section diameter may be about 99%, 95%, etc., of the bumper diameter). In this manner, a label adhered to a portion of the waist section 110 may be protected from abrasion damage should the container 10 rub against an adjacent container during shipping and handling. In other words, the top bumper 130 may impact adjacent containers, rather than a label or other markings on the waist section. In some embodiments, the top bumper 130 may have a thicker wall than adjacent container sections to help provide additional durability against side impacts and abrasion.

The container 10 may have a large opening in comparison to a diameter of the waist section in order to allow a consumer to access goods that fall to the bottom or adhere to the sides of the container 10. For example, a ratio of a diameter of the outlet opening to a diameter of the waist section 140 may be greater than 0.5 in some embodiments. As a result, a consumer may be able to insert a tool to scrape a viscous product off of interior walls of the container 10.

In some cases, large compressive loads pushing downward on a container may cause unreinforced walls to buckle. This may be especially problematic for container having thin container walls with a large surface area. Such walls may be unable to provide a radial force counteracting bending moments resulting from off-center vertical loads, such as those experienced during shipping and handling. Additionally, when a thin wall buckles, the buckling movement may give rise to stress raisers, which could focus forces on a small area and cause material failure. If the container holds a liquid or a food, a hole in a wall may be unacceptable for a consumer.

Thus, a container 10 according to various embodiments of the present disclosure may include reinforcement ribs to help prevent buckling. As may be understood from FIG. 4, the waist section 140 may include at least one (e.g., 2, 3, 4, 5, or 6) substantially horizontal, ring-shaped structural ribs 150A-150C that, for example, may be substantially evenly vertically spaced apart from each other as shown in FIG. 4. In various embodiments, the structural ribs 150A-C may, for example, have a diameter that is slightly less than (e.g., between about 95% and about 99.5% of) the diameter of the rest of the waist. These ribs may provide a ring of material lying substantially in a horizontal plane, which may provide resistance to radial forces caused during wall deformation. As a result of the rib providing additional material in a horizontal plane, the rib reinforces the wall against buckling without having to provide a thicker cylinder wall for the entire container. Further, a rib according to various embodiments of the present disclosure may remain flexible, and, as a result, may help to absorb and dissipate compressive forces, such as from a drop. Absorbing these forces may avoid high stresses which could cause buckling, stress risers, and cracks. As a result, the container 10 may have greater durability than a container without ribs.

Further, the ribs 150A-150C may be grouped in a region of the waist section 140. For example, the waist section may include a panel portion having the shape of a wall of a cylinder. The panel portion may secure a label, or may include printed identification material of a product within the container 10. A bottom edge of the panel portion may lie substantially on a plane that is substantially perpendicular to (e.g., perpendicular to) the central axis of the outlet, such that the panel portion lies on a first side of the plane. Further, at least one structural rib may be disposed on a second side of the plane. For instance, as shown in FIG. 4, the ribs 150A-150C are all disposed within the bottom half of the container 10, while the waist section 140 includes a flat area (i.e., a panel portion) within the top half of the container. However, in alternative embodiments, the structural ribs may be disposed in any other suitable location.

FIG. 4 also illustrates a base 170 below the waist section 140. The base may include a bottom bumper 160. The bottom bumper 160 may have a larger radius than the waist section 140, such that a label covering a portion of or the entire waist section 140 is prevented from sliding longitudinally along the container 10. Further, the maximum radius of the top bumper 130 may be substantially equal to a maximum radius of the bottom bumper 160. As a result, the respective top bumpers and bottom bumpers of adjacent containers may come into contact during shipping and handling, reducing abrasion on labeling and marking that may be provided in the waist section 140.

Further, because the container may hold a large volume of a good (e.g., 1 gallon), the container 10 may cause a large spill if tipped. Additionally, any spills from a tipped container may grow rapidly due to the large opening of the container 10. To help avoid spills, the base 170 may have a diameter that is greater than 0.5 times a height of the container 10. For example, the container 10 may have a height of 9 inches, and a base diameter of 6 inches. Further, the force of gravity on the container contents may provide a force downward along the central axis of the container 10. As a result of the base diameter being at least half of the height of the container, a significant fraction (e.g., at least ⅓) the force of gravity on the contents may be directed substantially perpendicular to a moment arm along by a line between a rim of the base and the center of gravity of the contents of a full container. That is, decreasing an angle between the base and the center of gravity about a particular point on the rim also increases the fraction of the gravitational force that is substantially perpendicular to the moment arm, as well as increasing the moment. As a result, the moment about a particular point on the rim due to gravity increases, thereby increasing a force required to tip the container and cause a spill. Thus, the dimension of the container 10 may decrease the likelihood of incidental bumps during shipping and consumer handling causing a spill.

Figure 9:
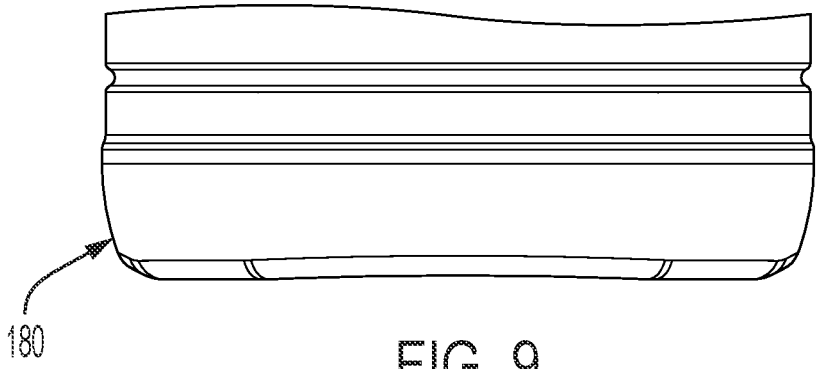
FIG. 9 is a detailed front bottom view of the container shown in FIG. 1.

In certain embodiments, the base 170 may include gradually tapering lower portion 180, as illustrated further in FIG. 9. For example, the base 170 may be constructed such that each horizontal cross section has a substantially circular outer shape. As may be understood from FIG. 4, below a certain height, the circumference of the base 170 may decrease in a gradually tapering lower portion 180 from at least about halfway up the base 170 to the bottom of the base 170. Because this gradual tapering lower portion 180 has a reducing circumference in a longitudinal direction, the material used to create this section may have a gradually increasing thickness, for instance in embodiments where a roughly constant amount of material is used to create each horizontal cross section. The thicker material in the gradually tapering lower portion may provide greater durability against drops, for instance. Further, by gradually reducing the circumference, stress raisers may be avoided which could cause material failure and crack propagation.

Figure 5:
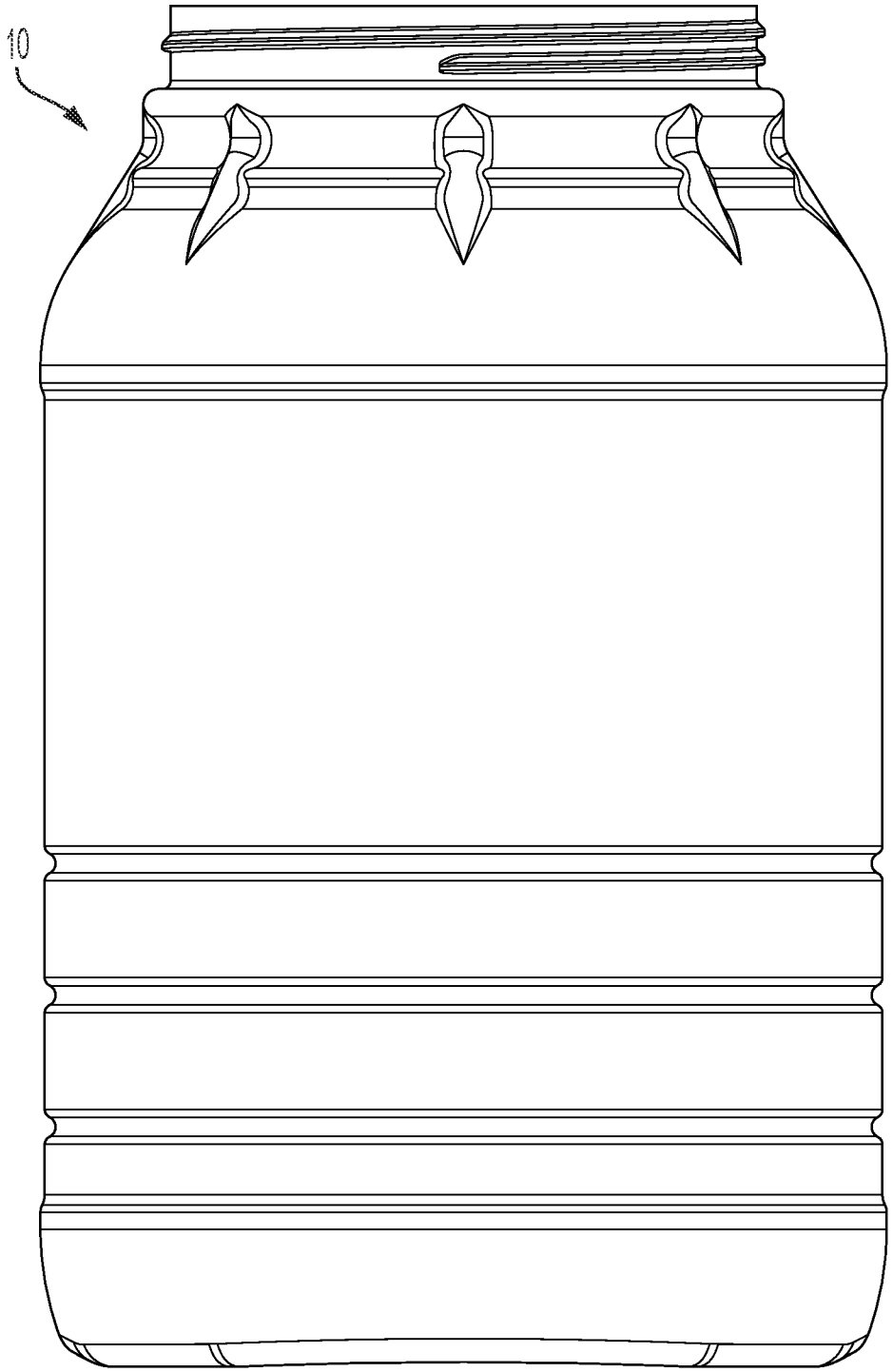
FIG. 5 is a rear view of the container of FIG. 1.
Figure 6:
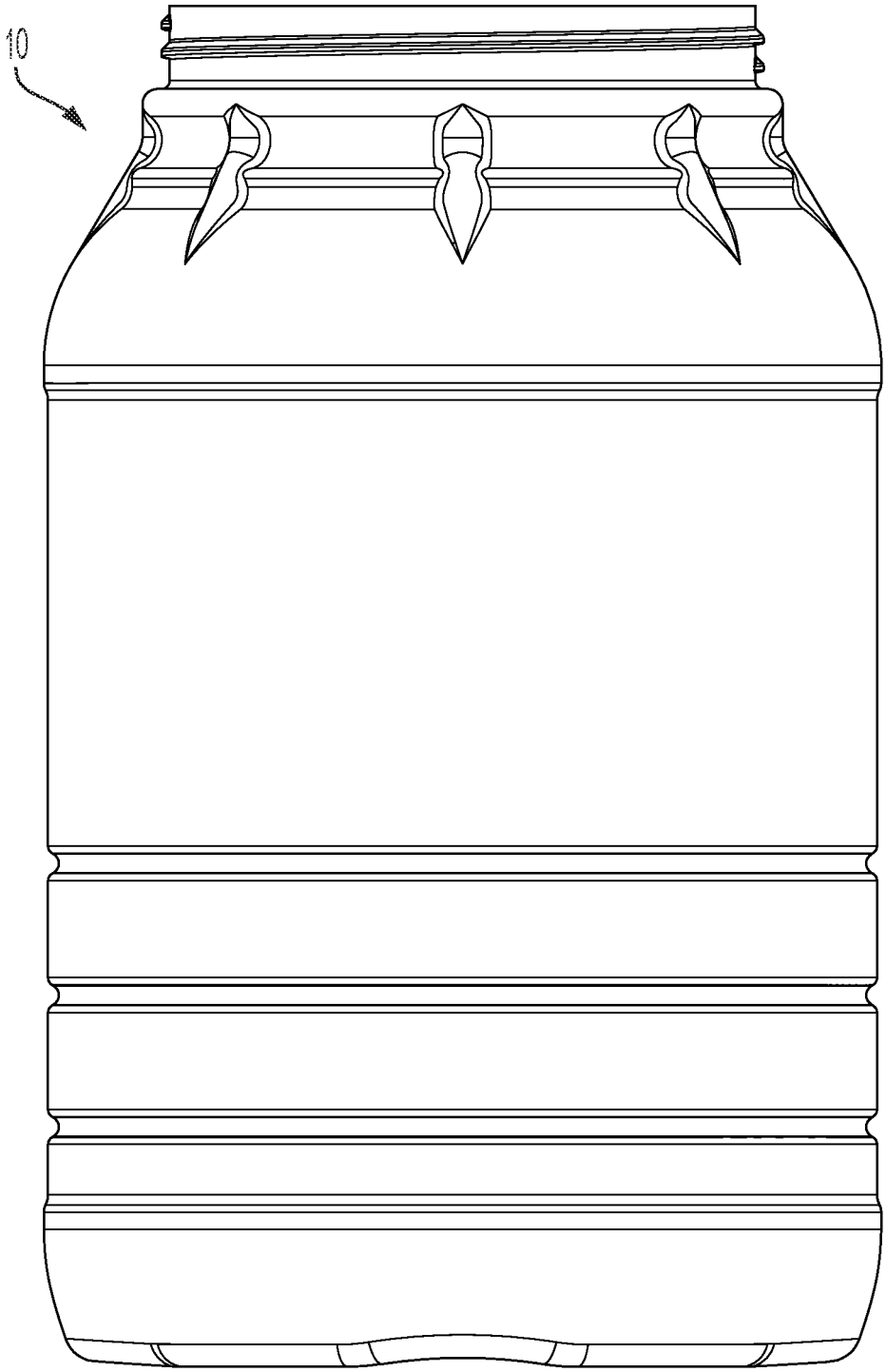
FIG. 6 is a right side view of the container of FIG. 1.
Figure 7:
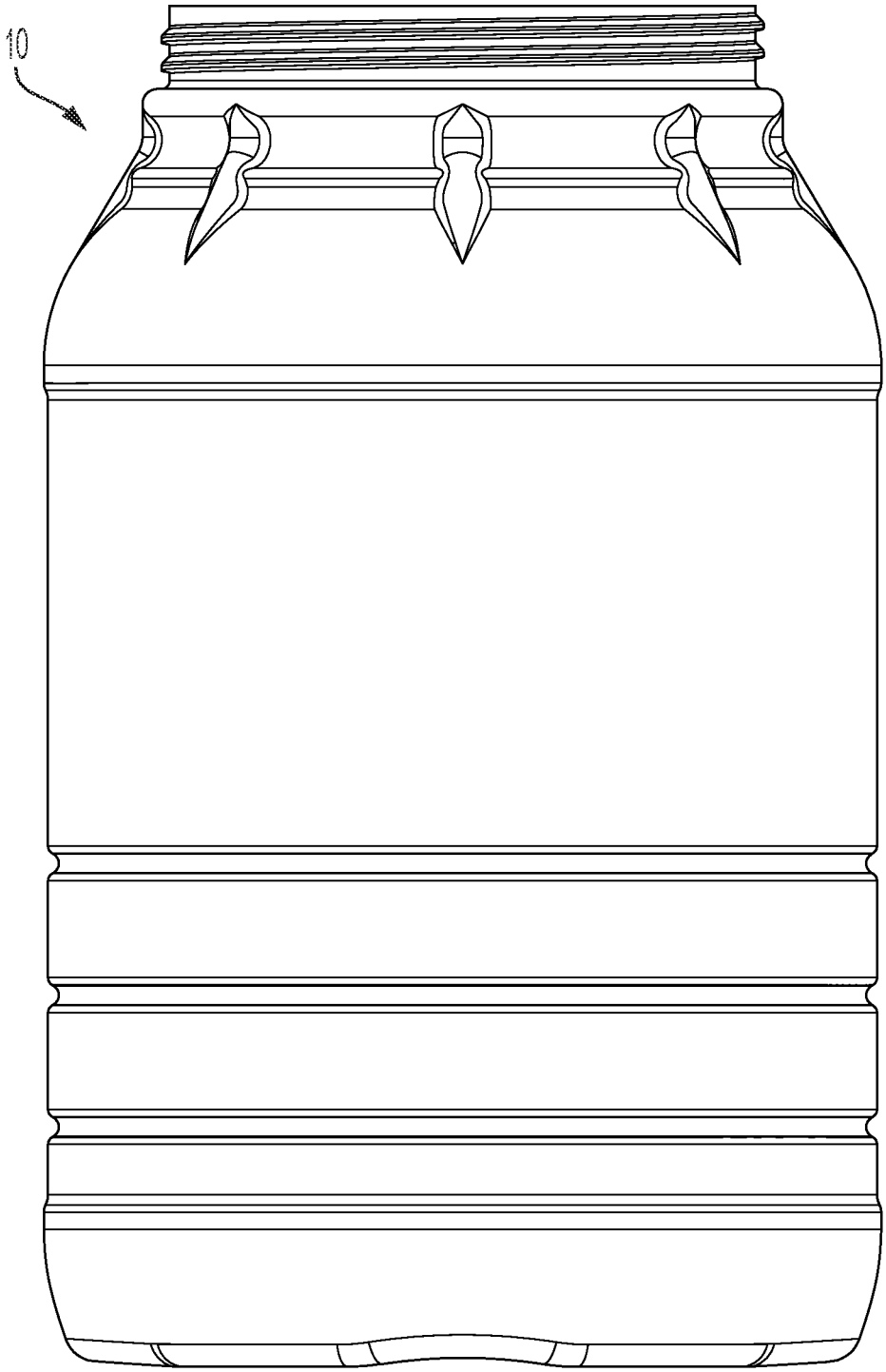
FIG. 7 is a left side view of the container shown in FIG. 1.

FIGS. 5-7 illustrate the container 10 from alternate sides. As may be understood from these figures, in various embodiments, the container's neck portion 110, shoulder 120, waist section 140, and base 170 may all be symmetrical about the container's central, vertical axis. This may, for example, contribute to providing a container with a substantially uniform top load strength across the top of the container 10.

Figure 8:
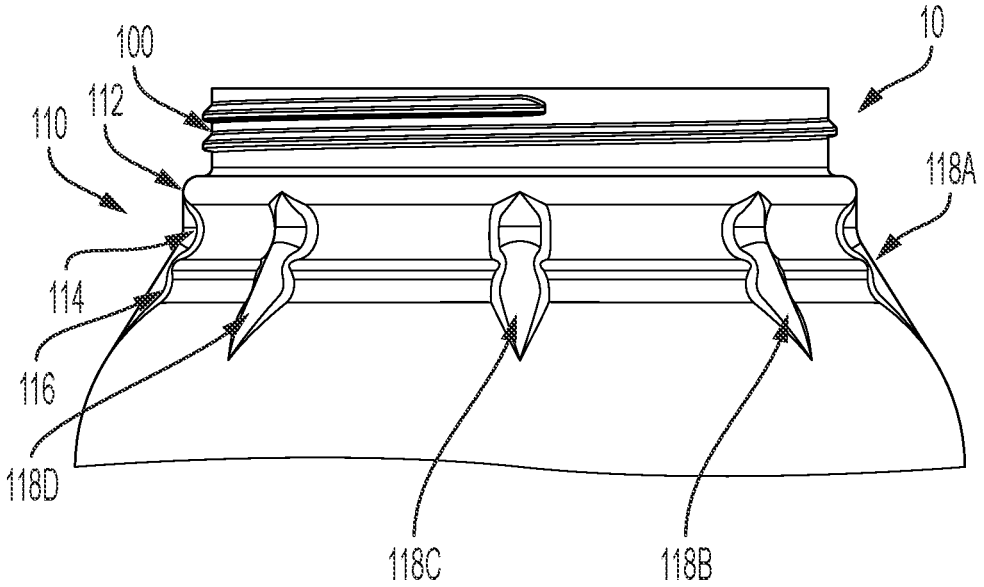
FIG. 8 is a detailed front top view of the container shown in FIG. 1.
Figure 10:
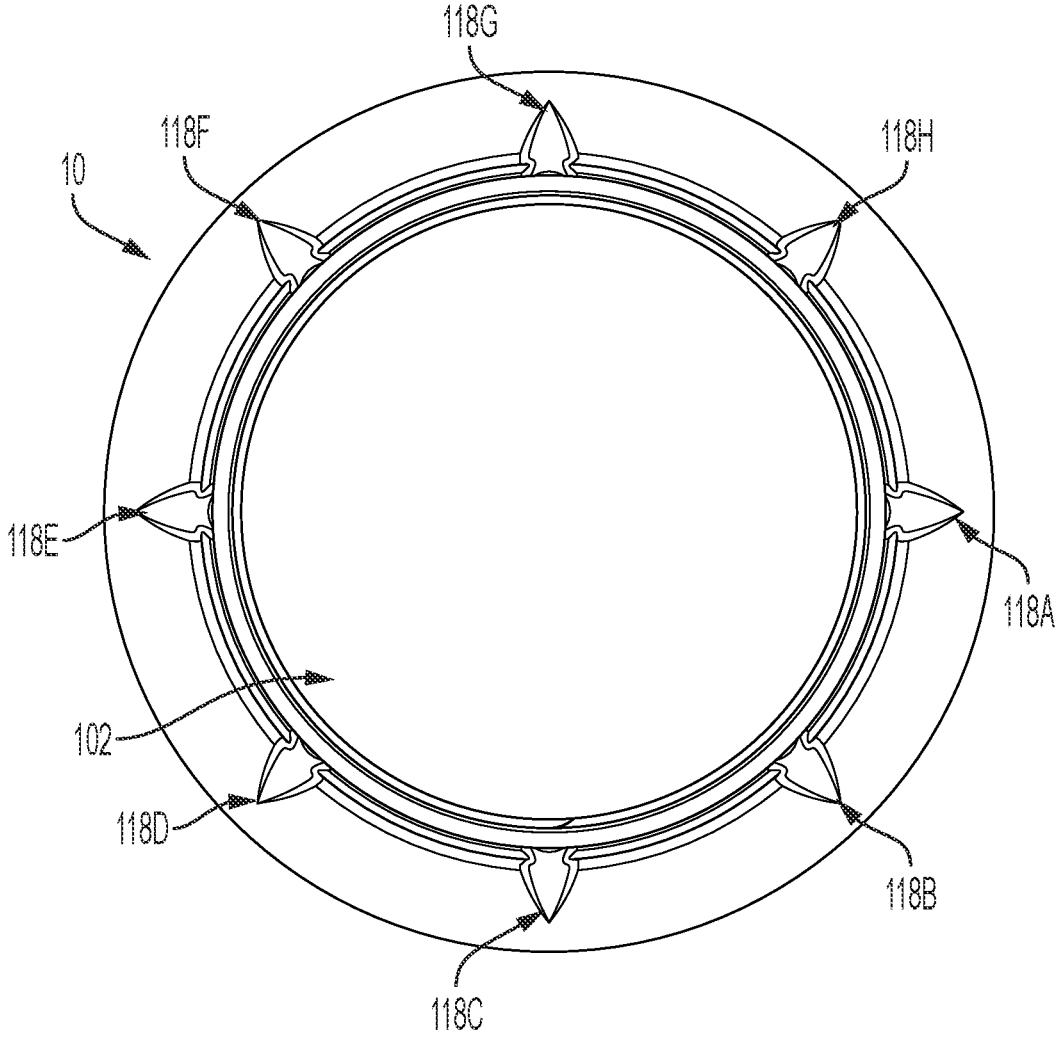
FIG. 10 is a top plan view of the container shown in FIG. 1.

Turning to FIGS. 8 and 10, the neck portion 110 may comprise an upper structural ring 112 that is disposed adjacent a bottom portion of the outlet 100. The upper structural ring may substantially lie in a first plane that is substantially perpendicular to the central axis of the outlet 100. The neck portion 110 may further comprise a lower structural ring 116 that is spaced apart from, and disposed parallel to and below, the upper structural ring 112. Thus, the lower structural ring 116 may lie in a second plane which is substantially perpendicular to the central axis. Further, the first plane and the second plane may be separated by a vertical distance.

The upper and lower structural rings 112, 116 may be connected by a first, substantially-circular connecting portion 114 having a concave exterior profile as shown in FIG. 8. The lower structural ring 116 may be connected to the top of the container's shoulder by a second, substantially circular connector portion. In particular embodiments, the exterior of this second connector portion is also concave. The upper and lower structural rings 112, 116 may provide reinforcing forces resisting movement of adjacent vertical portions in a radial direction, for instance under a compressive force.

The upper and lower structural rings are also connected by a plurality of elongated gussets 118A-118D that, respectively, extend from the upper structural ring 112 to the lower structural ring 116 in a direction that is substantially perpendicular to both the upper structural ring 112 and the lower structural ring 116. As shown in FIG. 8, each gusset 118A-118D further extends below the lower structural ring 116. In this manner, each gusset 118A-118D may also reinforce adjacent sections of the neck portion 110 and, in some embodiments, adjacent sections of the shoulder 120. Thus, the gussets 118A-118D may be attached to (e.g., by being integrally constructed with) the container's shoulder portion 120, the upper structural ring 112, and the lower structural ring 116.

In particular embodiments, such as the embodiment shown in FIG. 8, the respective ends of the gussets 118A-118D are tapered so that they become narrower as they extend downwardly from the lower structural ring 116. The gussets 118A-118D may therefore taper adjacent a respective distal end. Additionally, as illustrated by the gusset 118A in FIG. 8, in some embodiments, a section of an outer surface of the gusset may be tangential to a point on a curve of the neck portion. A tapered portion of a gusset may have a length proportional to a distance between a tangent point and the lower structural ring as a result. This may allow the gussets 118A-118D to blend into the shoulder 120, for instance, without an abrupt shape change that could focus forces, while also providing additional support to the shoulder 120. Similarly, a section of an outer surface of the gusset may also be tangential to the upper structural ring and thus parallel to the central axis. In this manner, a gusset may bridge the circular connecting portion 114 between the upper and lower structural rings 112, 116 to help resist compressive loads while the upper and lower structural rings 112, 116 help resist radial forces. The structure of the gussets 118A-118D and the upper and lower structural rings 112, 116 may thus enable the neck portion 110 and shoulder 120 to transfer loads to the base 170 via the waist section 140 despite the neck portion 110 and shoulder 120 having a smaller diameter than the waist section 140. This load transferring structure allows the outlet 100 to have a diameter sized so a consumer's hand may easily remove a lid secured to the outlet, while the wider-diameter waist section 140 and base 170 enables the container 10 to hold a large amount of a product, all without the container 10 deforming or rupturing due to high compressive loads in a shipping or storage arrangement.

Further, the gussets 118A-118D may be symmetric about a plane. For example, the gusset 118C is symmetric about a plane of symmetry running vertically. Further, the plane of symmetry of the gusset 118C substantially bisects the container 10. Thus, the central axis of the outlet may lie in the plane of symmetry of the gusset 118C. This symmetry may help disperse pressure that may otherwise be localized and cause material failure. Additionally, each gusset 118A, 118B, and 118D may also be symmetric, and have respective planes of symmetry. The central axis may lie in each respective plane of symmetry, such that the respective planes of symmetry substantially intersect along the central axis.

FIG. 10 illustrates a top plan view of the container 10 shown in FIG. 1. This view illustrates that the container 10 may, in certain embodiments, include eight gussets 118A-118H. The gussets 118A-118H may be substantially evenly (e.g., evenly) spaced apart from each other about a circumference of the neck portion. For example, in embodiments where the container 10 has 4 gussets, the gussets may be disposed at 90 degree increments. In the embodiment shown in FIG. 10 having 8 gussets, the gussets may be disposed at 45 degree increments.

Figure 11:
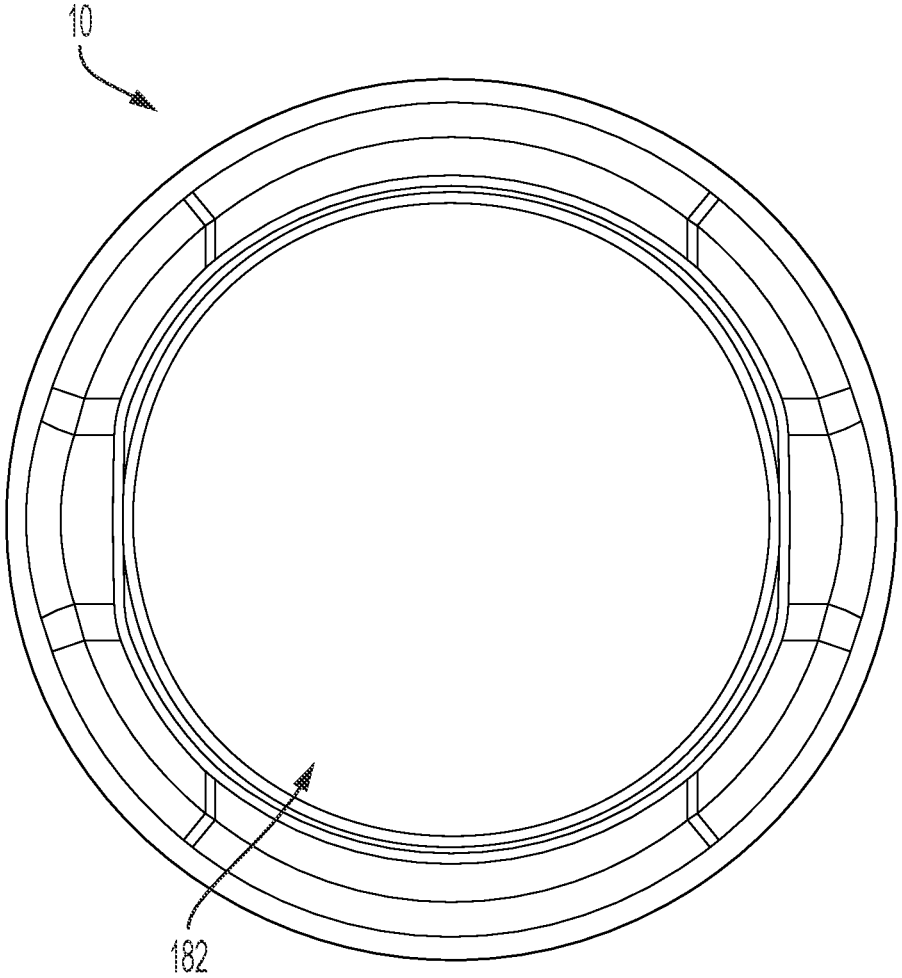
FIG. 11 is a bottom plan view of the container shown in FIG. 1.
Figure 12:
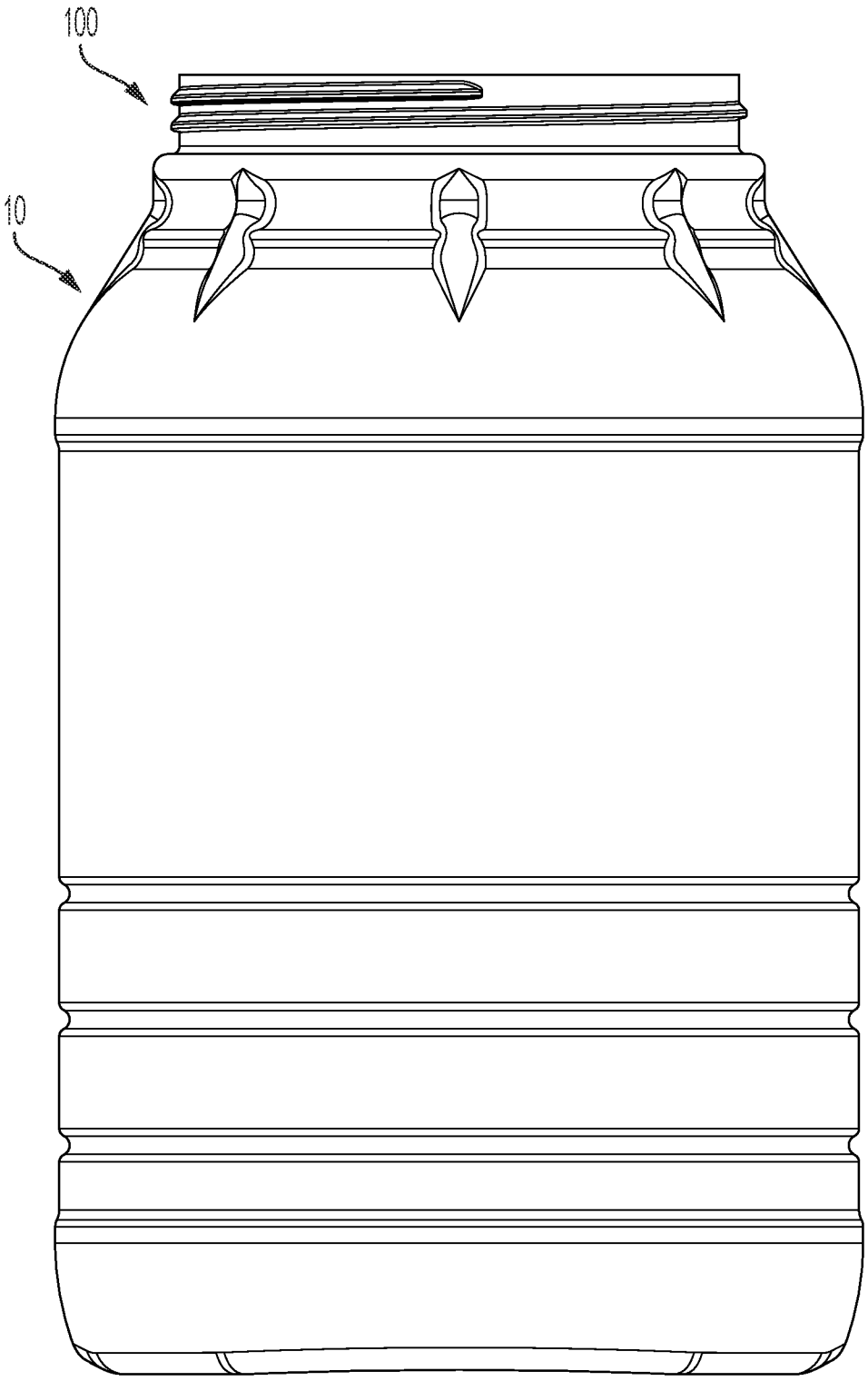
FIG. 12 is a front elevation view of a container according to a second embodiment.
Figure 13:
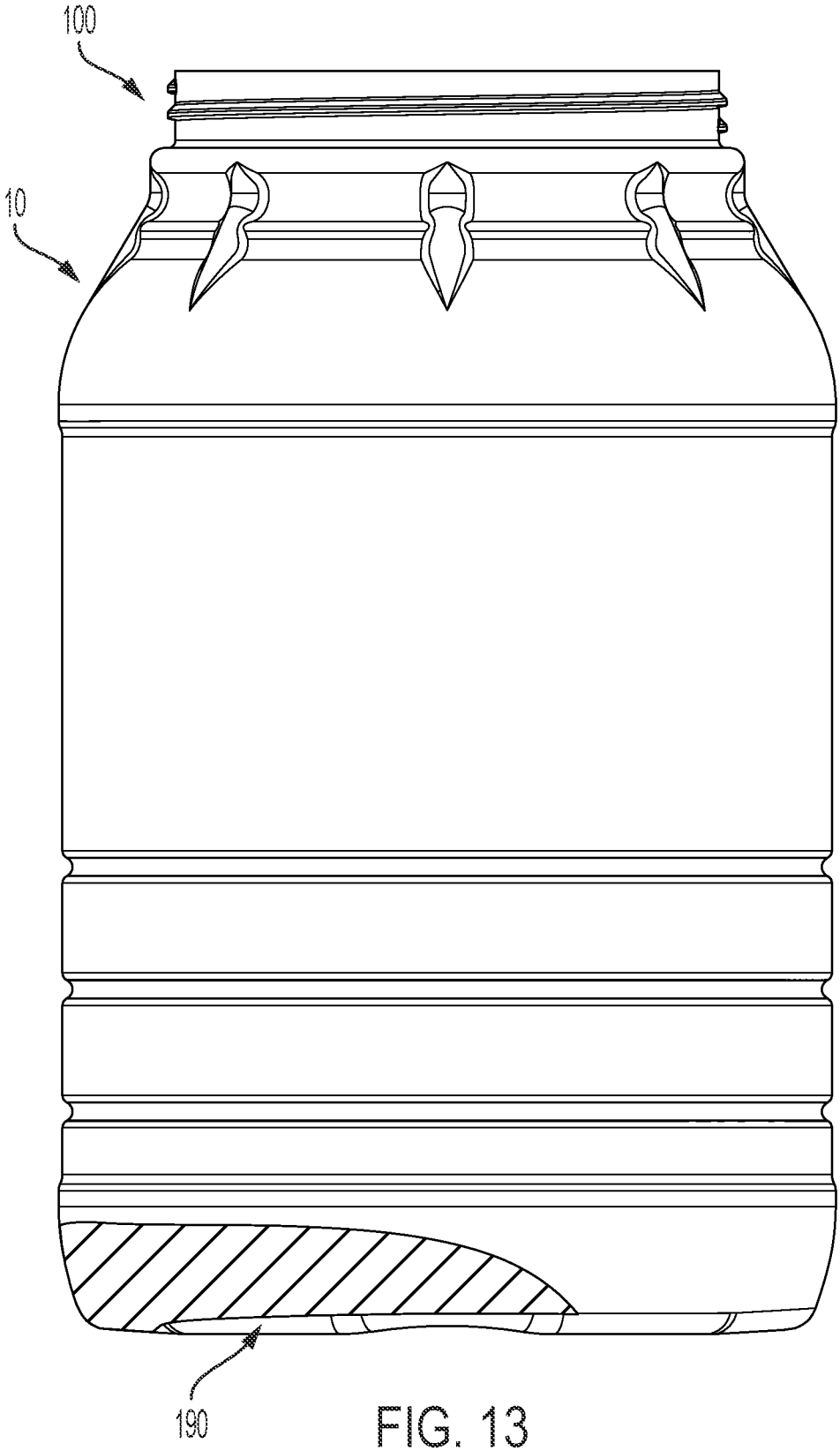
FIG. 13 is a right elevation view of the container of FIG. 12.
Figure 14:
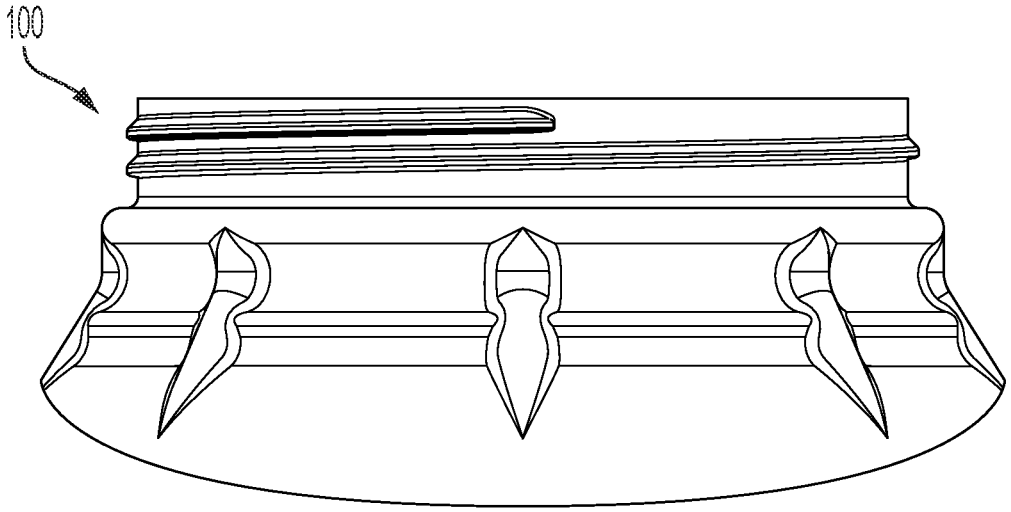
FIG. 14 is a detailed front top view of the container of FIG. 12.

FIG. 11 illustrates a bottom plan view of the container 10 shown in FIG. 1. The bottom plan view illustrates a base recess 182. The base 170 may define the base recess 182 in a bottom portion of the base. The base recess 182 may have a volume dimensioned such that the interior volume of the container 10 is a certain desired value without altering other dimensions of the container 10. In this manner, a merchant or shipper may still stack containers 10 despite the containers 10 having different interior volumes. Additionally, the base recess 182 may have an inside diameter greater than a diameter of the outlet 100. This may enable an outlet 100 and lid of a bottom container to nest inside of a base recess 182 of a top container for shipping and storage. By nesting containers in this manner, containers may be stored securely and compactly, reducing risk of damage to the containers, as well as shipping costs.

Figure 15:
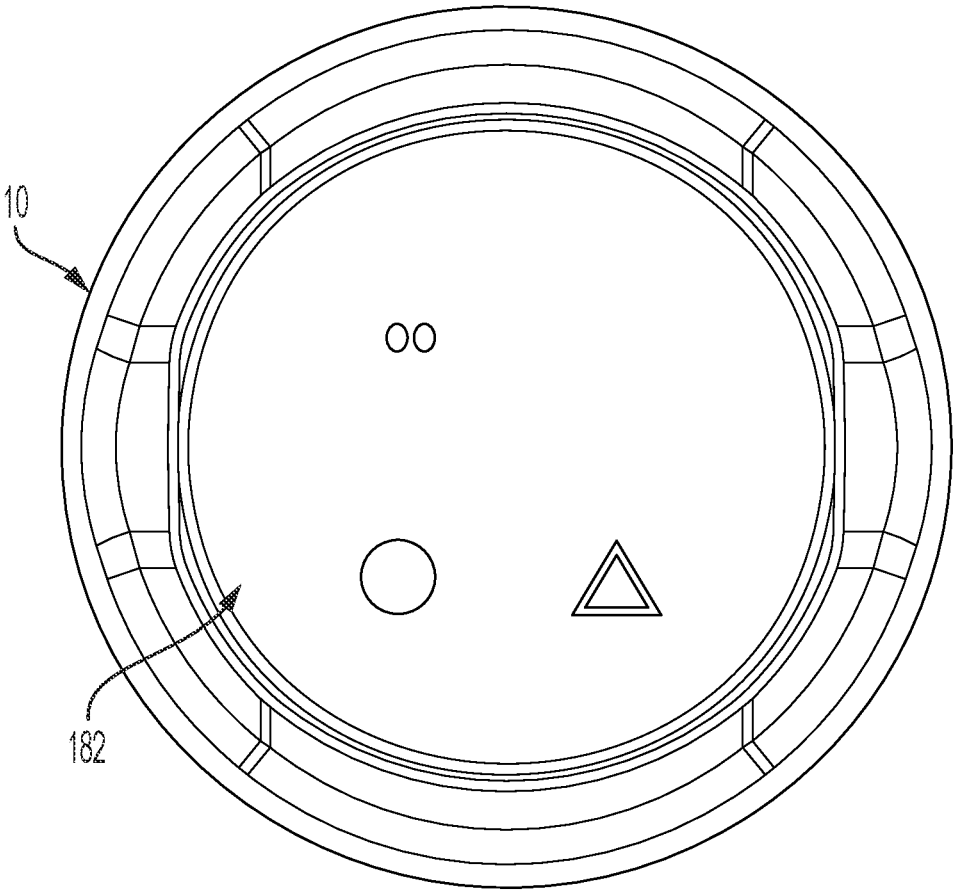
FIG. 15 is a bottom plan view of the container of FIG. 12.

FIGS. 12-15 show various example dimensions of a container according to a particular embodiment. It should be noted that, in this embodiment, as shown in FIG. 15, the container includes a recessed bottom portion 182 which may include markings for recycling, branding, or any other suitable information. In some embodiments, these markings may be printed, etched, or molded as part of the formation of the container.

As stated above, in certain embodiments, the container 10 may be formed by a blow molding process. For instance, manufacturing of the container 10 may begin with heating a tube of material until the material is above particular temperature. For example, the temperature may be a glass transition temperature of the material, such that the material transitions from a crystalline or semi-crystalline structure into a malleable form, but is not sufficiently heated to cause the material to become liquid or burn. The material may be heated by heated air, radiative heating elements, or any other suitable heating method.

The heated tube may be substantially surrounded by a mold configured to form the features of the container 10. The mold may have multiple pieces (e.g., a left and right side). The mold may also have multiple portions, each corresponding to a portion of the container. For example, the mold may comprise a top portion configured to form the outlet 100, neck portion 110, and shoulder 120. Accordingly, the top portion may comprise a top horizontal recess configured to form an upper structural ring (e.g., the upper structural ring 112), and a lower horizontal recess configured to form a lower structural ring (e.g., the lower structural ring 116). The mold may also comprise a middle protrusion disposed between the top horizontal recess and the lower horizontal recess, which may correspond to the circular connection portion 114 described above. Further still, the mold may comprise a plurality of gusset recesses configured to form a plurality of gussets extending between the upper structural ring and the lower structural ring.

The mold may also comprise a middle portion having a cylindrical section configured to form a panel section of the container and at least one horizontal rib protrusion having a radius less than a radius of the cylindrical section (e.g., the waist section 140 and the ribs 150A-150C). The mold may further comprise a bottom section configured to form a base of the container (e.g., the base 170). The bottom section of the mold may also include markings to be formed in the material of the container (e.g., material properties, recycling category, branding, etc.).

After the tube of material is substantially surrounded by the mold, the tube may be pressed against the mold, for instance using a pressurized gas to inflate the tube of malleable material. The pressure may cause the tube of malleable material to expand and substantially take on the shape of the mold. In some embodiments, the mold may be spun, for instance about a central axis, to force the material against the mold walls. Further, the mold may be cooled, such that heat from the tube of material may be removed causing the material to resolidify. After the material has resolidified, the material, now in the shape of the container 10, may be released from the mold, for instance by blowing the container off the mold walls, or by cooling the container 10 such that the material contracts and releases.

The concepts and technologies described herein are related to various embodiments of a container, which may, for example, be made of a suitable polymer. While the particular examples shown in FIGS. 1-15 are extrusion blow-molded containers, it should be understood that the containers could be made of any suitable material, using any suitable manufacturing techniques.

Conclusion

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for the purposes of limitation.

What is claimed is:

1. A container comprising:

a container body that defines both an interior portion and an outlet that is in fluid communication with the interior portion, the outlet having a central axis, wherein the container body comprises:

a substantially circular neck portion below the outlet, the neck portion having a profile comprising:

an upper convex portion forming an upper structural ring lying in a first plane that is substantially perpendicular to the central axis;

a lower convex portion forming a lower structural ring lying in a second plane that is substantially perpendicular to the central axis, the first plane and the second plane being separated by a vertical distance;

a middle concave portion lying between the upper structural ring and the lower structural ring such that an exterior surface of the neck portion between the upper structural ring and the lower structural ring defines a continuous curve; and a gusset extending between the upper structural ring and the lower structural ring, the gusset having a plane of symmetry, an outer surface bisected along a vertical length by the plane of symmetry, and a varying width along the vertical length, wherein an upper section of the gusset along the plane of symmetry and a lower section of the gusset along the plane of symmetry are oblique with respect to one another, and wherein the central axis lies in the plane of symmetry;

a shoulder portion that is disposed beneath the neck portion;

a waist section that is disposed beneath the shoulder portion; and a base that is disposed beneath the waist section.

2. The container of claim 1, wherein a volume of the interior portion of the container is approximately 1 gallon.

3. The container of claim 1, further comprising a plurality of gussets, each extending between the upper structural ring and the lower structural ring, and each gusset having a respective plane of symmetry; wherein the central axis lies in each respective plane of symmetry.

4. The container of claim 3, wherein the plurality of gussets are substantially evenly spaced apart from each other about a circumference of the neck portion.

5. The container of claim 3, wherein the plurality of gussets comprises at least 4 gussets.

6. The container of claim 3, wherein each gusset further extends below the lower structural ring.

7. The container of claim 3, wherein each respective one of the gussets tapers adjacent a distal end of the gusset.

8. The container of claim 1, wherein the upper structural ring, the lower structural ring, and the gusset are integrally formed with each other.

9. The container of claim 1, wherein a section of an outer surface of the gusset is tangential to a point on a curve of the neck portion.

10. The container of claim 1, wherein a section of an outer surface of the gusset is parallel to the central axis.

11. The container of claim 1, wherein the waist section comprises at least one horizontal structural rib.

12. The container of claim 11, wherein:

the waist section comprises a panel portion lying to a first side of a third plane, the third plane being parallel to the first plane; and the at least one horizontal structural rib lies to a second side of a third plane.

13. The container of claim 1, wherein the shoulder comprises a top bumper;

the base comprises a bottom bumper, a maximum radius of the top bumper is greater than a maximum radius of the waist section; and the maximum radius of the top bumper is substantially equal to a maximum radius of the bottom bumper.

14. The container of claim 1, wherein a ratio of a diameter of the opening to a diameter of the waist section is greater than 0.5.

15. The container of claim 1, wherein a ratio of a diameter of the base to a height of the container is greater than 0.5.

16. The container of claim 1, wherein the base comprises a gradually tapering lower portion.

17. The container of claim 1, wherein the base defines a base recess in a bottom portion of the base.

18. The container of claim 17, wherein the base recess has an inside diameter greater than a diameter of the outlet.

* * * * *